US010214343B2

(12) United States Patent
Li Vigni et al.

(10) Patent No.: US 10,214,343 B2
(45) Date of Patent: Feb. 26, 2019

(54) PACK FOR TOBACCO ARTICLES PROVIDED WITH A SEALED WRAP WITH AN INNER PRESSURE THAT IS DIFFERENT FROM THE ATMOSPHERIC PRESSURE AND RELATIVE WRAPPING METHOD

(71) Applicant: G.D SOCIETA' PER AZIONI, Bologna (IT)

(72) Inventors: Angelo Li Vigni, Bologna (IT); Luca Federici, Bologna (IT)

(73) Assignee: G.D. SOCIETA'PER AZIONI, Bologna (IT)

( * ) Notice: Subject to any disclaimer, the term of this patent is extended or adjusted under 35 U.S.C. 154(b) by 0 days.

(21) Appl. No.: 15/545,752

(22) PCT Filed: Jan. 29, 2016

(86) PCT No.: PCT/IB2016/050472

§ 371 (c)(1),
(2) Date: Jul. 24, 2017

(87) PCT Pub. No.: WO2016/120848

PCT Pub. Date: Aug. 4, 2016

(65) Prior Publication Data

US 2018/0022538 A1 Jan. 25, 2018

(30) Foreign Application Priority Data

Jan. 29, 2015 (IT) ..... BO2015A0032

(51) Int. Cl.
*B65D 85/10* (2006.01)
*B65D 81/20* (2006.01)
(Continued)

(52) U.S. Cl.
CPC ..... *B65D 85/1045* (2013.01); *B65B 11/004* (2013.01); *B65B 19/22* (2013.01);
(Continued)

(58) Field of Classification Search
USPC ..... 206/259, 264, 265, 268
See application file for complete search history.

(56) References Cited

U.S. PATENT DOCUMENTS 2,910,175 A * 10/1959 Williams ..... B65D 75/54 206/259
3,999,655 A * 12/1976 Molins ..... B65D 75/68 206/259

(Continued)

FOREIGN PATENT DOCUMENTS

WO WO-98/49072 A1 11/1998
WO WO-2009/083344 A2 7/2009
WO WO-2014/013478 A1 1/2014

OTHER PUBLICATIONS

International Search Report and Written Opinion, International Application No. PCT/IB2016/050472, dated May 3, 2016.

(Continued)

*Primary Examiner* — Jacob K Ackun
(74) *Attorney, Agent, or Firm* — Marshall, Gerstein & Borun LLP

(57) ABSTRACT

A pack provided with: a group of tobacco articles; and a sealed wrap, which encloses the group of tobacco articles, has a pull-out opening for the tobacco articles, has an inner pressure that is different from the atmospheric pressure, and consists of a heat-sealable sheet of wrapping material, which is folded around the group of tobacco articles and is stabilized by means of heat-sealing.

5 Claims, 14 Drawing Sheets

(51) Int. Cl.

| | |
|---|---|
| ***B65B 11/00*** | (2006.01) |
| ***B65B 19/22*** | (2006.01) |
| ***B65B 51/10*** | (2006.01) |
| ***B65B 53/02*** | (2006.01) |
| ***B65D 5/66*** | (2006.01) |
| ***B65D 77/02*** | (2006.01) |

(52) U.S. Cl.
CPC ..... *B65B 51/10* (2013.01); *B65B 53/02* (2013.01); *B65D 5/662* (2013.01); *B65D 77/02* (2013.01); *B65D 81/203* (2013.01); *B65D 81/2061* (2013.01); *B65D 85/1081* (2013.01)

(56) References Cited

U.S. PATENT DOCUMENTS

| | | | | |
|---|---|---|---|---|
| 4,300,676 | A | 11/1981 | Focke et al. | |
| 6,164,444 | A * | 12/2000 | Bray | B65D 75/5838 206/268 |
| 8,276,750 | B2 * | 10/2012 | Biondi | B65D 77/02 206/259 |
| 8,365,978 | B2 * | 2/2013 | Yoshimura | B65D 5/5425 206/264 |
| 8,590,701 | B2 * | 11/2013 | Bertuzzi | B65D 5/543 206/264 |
| 2003/0164314 | A1 * | 9/2003 | Bray | B65D 75/5838 206/264 |
| 2011/0042249 | A1 | 2/2011 | Guerrera et al. | |
| 2016/0096678 | A1 * | 4/2016 | Tacchi | B65D 85/1036 206/264 |

OTHER PUBLICATIONS

International Preliminary Report on Patentability (Chapter II), International Application No. PCT/IB2016/050472, dated Mar. 8, 2017.

* cited by examiner

PACK FOR TOBACCO ARTICLES PROVIDED WITH A SEALED WRAP WITH AN INNER PRESSURE THAT IS DIFFERENT FROM THE ATMOSPHERIC PRESSURE AND RELATIVE WRAPPING METHOD

CROSS-REFERENCE TO RELATED APPLICATIONS

This is the U.S. national phase of International Application No. PCT/IB2016/050472, filed Jan. 29, 2016, which claims the benefit of Italian Patent Application No. BO2015A000032, filed Jan. 29, 2015.

TECHNICAL FIELD

The present invention relates to a pack for tobacco articles provided with a sealed wrap and a relative wrapping method.

The present invention finds advantageous application to a packet of cigarettes provided with a sealed wrap, to which the following description will make explicit reference without thereby losing generality.

PRIOR ART

A packet of cigarettes normally comprises an inner wrap, which consists of a group of cigarettes wrapped in an inner sheet of wrapping material, and an outer cover, which encloses the inner wrap and can consist of an outer sheet of wrapping material folded around the inner cup-shaped wrap (soft type packet of cigarettes), or can consist of a rigid, hinged-lid box formed by folding a rigid blank around the inner wrap (rigid type packet of cigarettes).

In a conventional packet of cigarettes, the group of cigarettes is internally wrapped in a glue-free rectangular inner sheet of wrapping material made of metalized paper and is externally wrapped in a rectangular outer sheet of wrapping material which is stabilized by means of glueing.

The tobacco is very sensitive to external environmental effects, as being in contact with the atmosphere tends to alter its organoleptic characteristics due to the effect of moisture variations (tobacco can become too dry or can absorb too much moisture), both for the evaporation of the volatile substances with which the tobacco is impregnated (especially in the case of aromatized cigarettes with particular aromas such as cloves). To preserve the integrity of the cigarette tobacco, the packets of cigarettes are cellophane-wrapped, i.e. are covered with an external heat-sealed overwrap of waterproof plastic material. However, the external heat-sealed overwrap may not be sufficient to fully preserve the organoleptic characteristics of the tobacco contained in a packet of cigarettes, particularly when the packet of cigarettes is consumed after a certain lapse of time from the production thereof. Moreover, the outer overwrap is discharged the first time the packet is opened, and therefore the tobacco of the cigarettes contained in the pack comes in contact with the external environment; if the cigarettes contained in the packet are not quickly used after the first opening of the packet, the organoleptic characteristics of the remaining cigarettes may become degraded.

In the attempt to obviate the above described drawback, in U.S. Pat. No. 4,300,676A1 a rigid packet of cigarettes has been proposed, wherein the inner wrap is waterproof and consists of a sheet of wrapping material made of waterproof and heat-sealable material having a cigarette pull-out opening, which is closed by way of a reusable closing label.

The patent application WO2014013478A1 describes a sealed wrap of cigarettes that is provided with a cigarette pull-out opening closed by way of a reusable closing label and can have an internally controlled atmosphere (by way of introducing inert gas) or a lower pressure than the atmospheric pressure.

The patent application WO9849072A1 describes a sealed wrap of cigarettes which has a cigarette pull-out opening closed by a reusable closing label and can have a slightly lower inner pressure than the atmospheric pressure.

The patent application WO2009083344A2 describes a sealed wrap of cigarettes that can have a higher inner pressure than the atmospheric pressure caused by the addition of an inert gas.

The patent application US2011042249A1 describes a transparent plastic overwrap surrounding a packet of cigarettes and having a higher inner pressure than the atmospheric pressure caused by the addition of an inert gas.

When a sealed wrap has a different inner pressure than the atmospheric pressure (i.e. from the environmental pressure), the sealed wrap itself undergoes a deformation by effect of the differential between its inner pressure and the atmospheric pressure (i.e. the pressure of the external environment): in particular when the sealed wrap is depressurized the atmospheric pressure forces the sealed wrap to adhere to its content (i.e. to the group of cigarettes) by compressing its own content, whereas when the sealed wrap is pressurized the sealed wrap itself inflates. It was observed that said deformations of the sealed wrap due to the pressure differential between the inner pressure of the sealed wrap and the atmospheric pressure may confer to the sealed wrap a relatively unsightly aspect and may also impede the packaging process in which a blank is folded around the sealed wrap forming a sealed container enclosing the sealed wrap itself.

DESCRIPTION OF INVENTION

The object of the present invention is to provide a pack for tobacco articles provided with a sealed wrap and a relative wrapping method, which pack and wrapping method will allow to more effectively maintain the organoleptic characteristics of the tobacco articles and, at the same time, being easy and inexpensive to manufacture.

According to the present invention, a pack for tobacco articles provided with a sealed wrap and a relative wrapping method are provided, as set forth in the appended claims.

BRIEF DESCRIPTION OF THE DRAWINGS

The present invention will now be described with reference to the accompanying drawings, which illustrate some non-limiting examples of embodiments, wherein.

PREFERRED EMBODIMENTS OF THE INVENTION

Figure 1:
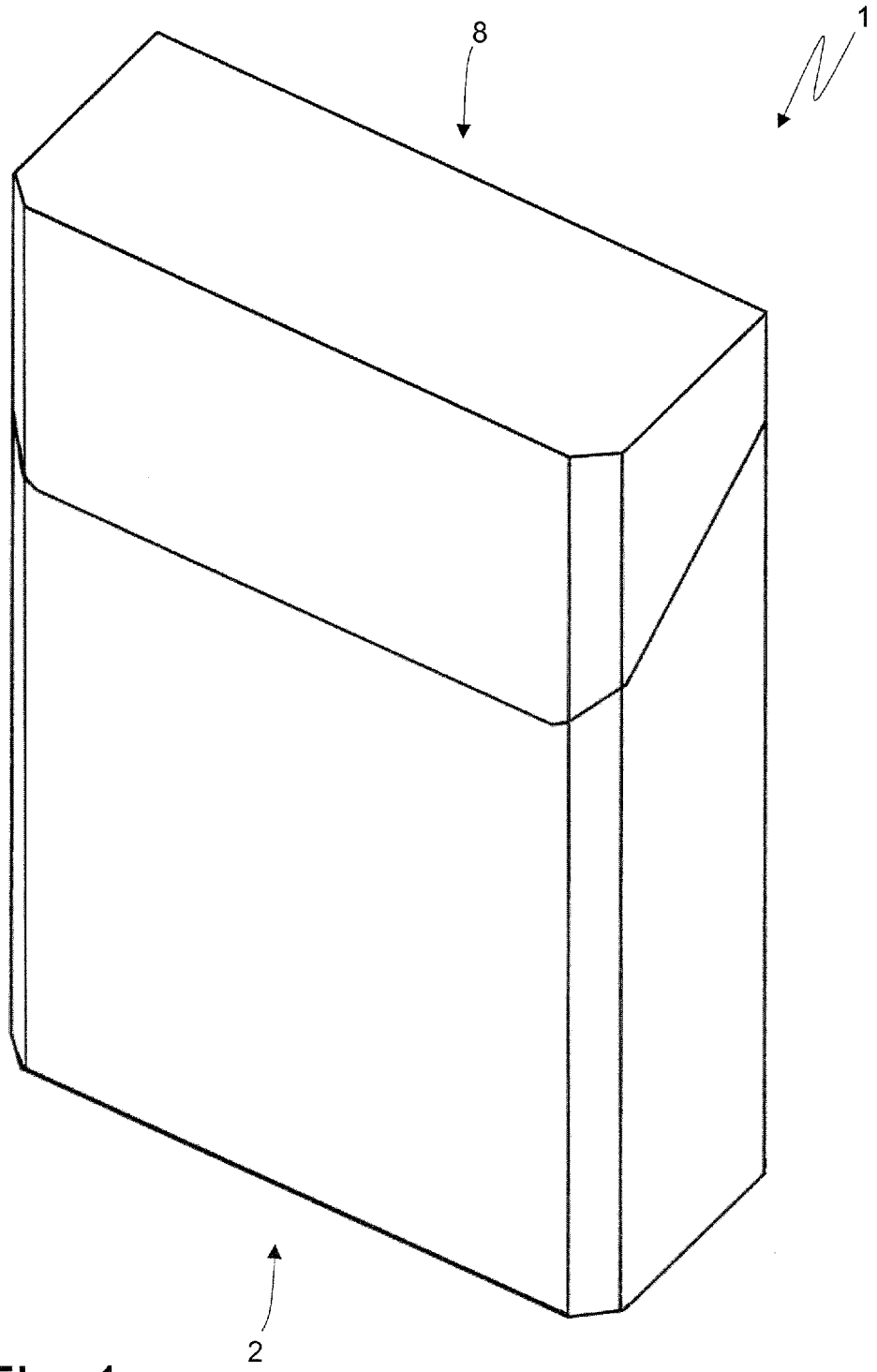
FIG. 1 is a front perspective view and in a closed configuration of a packet of cigarettes made according to the present invention and comprising a sealed wrap provided with a passage hole controlled by a pneumatic valve.
Figure 2:
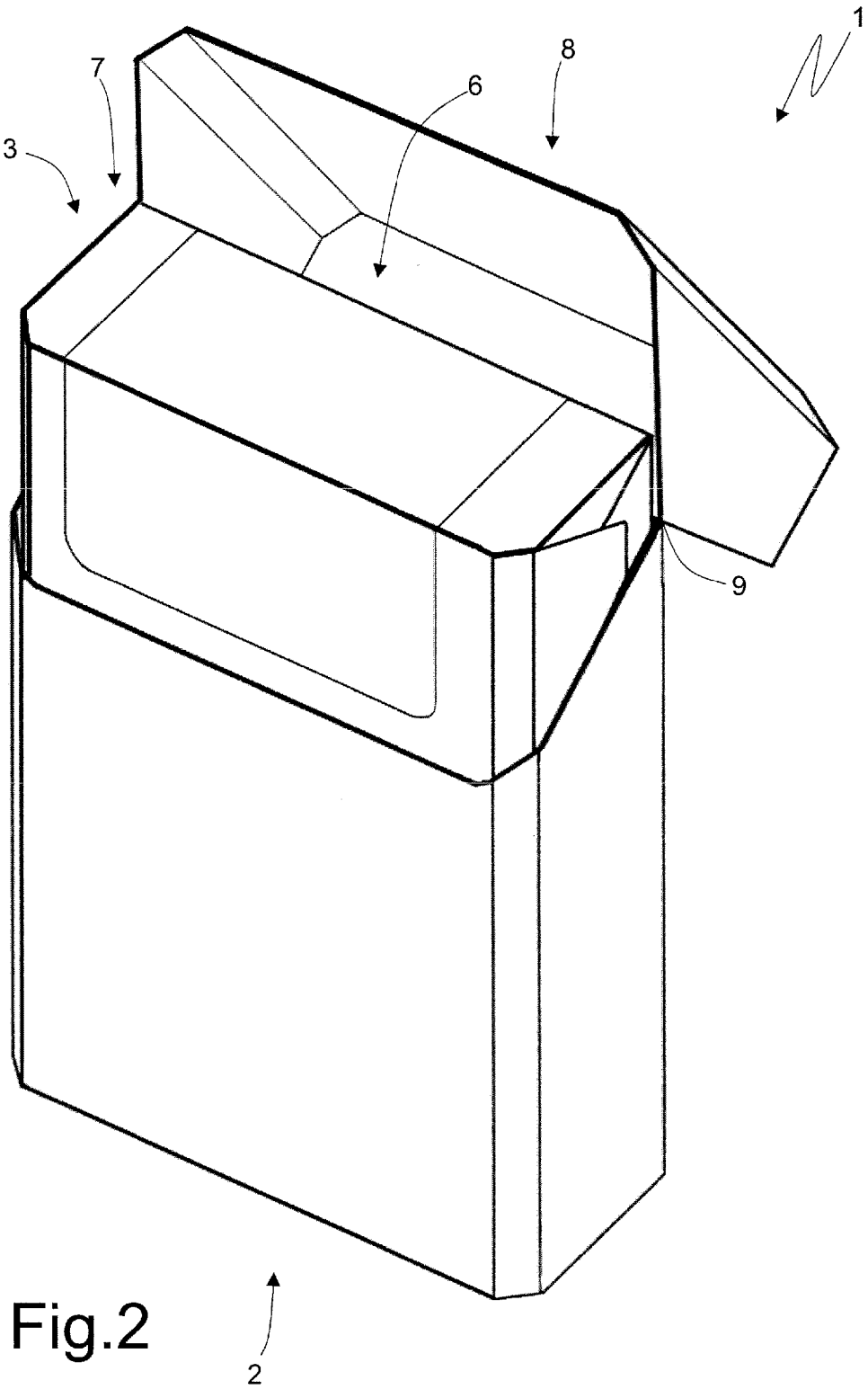
FIG. 2 is a front perspective view of the packet of cigarettes of FIG. 1 in a partially open configuration.
Figure 3:
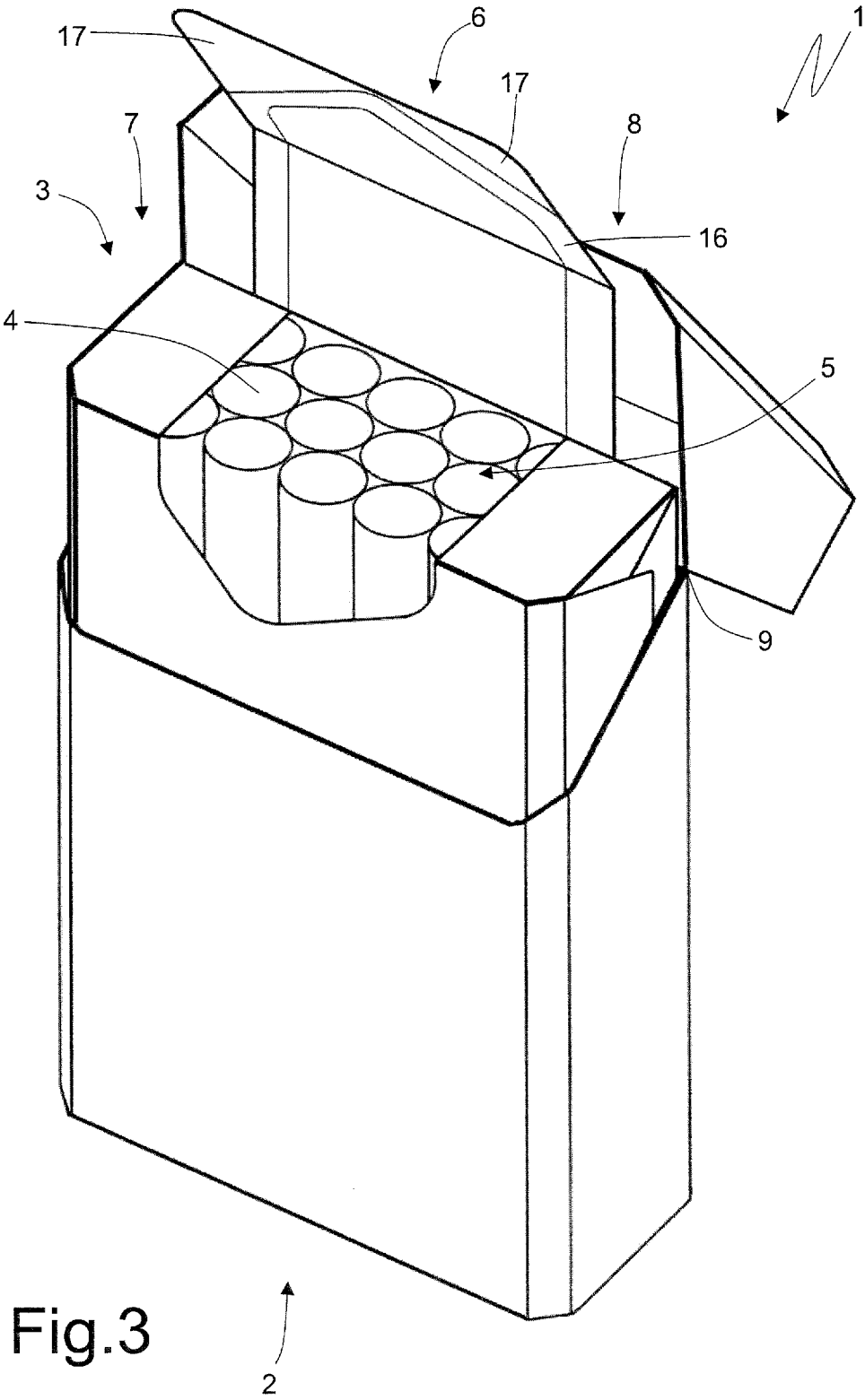
FIG. 3 is a front perspective view of the packet of cigarettes of FIG. 1 in a fully open configuration.

In FIGS. 1, 2 and 3 number 1 denotes as a whole a rigid packet of cigarettes. The packet 1 of cigarettes comprises a cup-shaped outer container 2 made of cardboard or rigid paperboard and a sealed wrap 3 (better illustrated in FIG. 4) housed inside the container 2. The sealed wrap 3 encloses a parallelepiped shaped group 4 of cigarettes (better illustrated in FIG. 5) and has at the top and in front a cigarette pull-out opening 5; the cigarette pull-out opening 5 is centrally arranged, being closed by an "open & close" type sealing panel 6 involving a portion of a front wall of the sealed wrap 3 and a portion of a top wall of the sealed wrap 3. The sealing panel 6 adheres normally to the part of the sealed wrap 3 arranged around the pull-out opening 5 to close (seal) the pull-out opening 5 and can be temporarily raised to free the pull-out opening 5, and thus allowing the extraction of a cigarette through the pull-out opening 5 itself.

According to a different embodiment not illustrated, the cigarette pull-out opening 5 involves the entire upper portion of the sealed wrap 3, the sealing panel 6 is absent, and the sealed wrap 3 is provided with a tear-off strip that allows removing a top portion of the sealed wrap 3 to free the pull-out opening 5; in other words, the first time the packet 1 of cigarettes is opened the user pulls the tear-off strip to remove an upper portion of the sealed wrap 3, and therefore free the pull-out opening 5.

The outer container 2 has an open top end 7 and is provided with a cup-shaped lid 8 which is hinged to the container 2 along a hinge 9 to rotate, with respect to the container 2, between an open position (illustrated in FIGS. 2 and 3) and a closed position (illustrated in FIG. 1) of the open top end 7.

The lid 8, when in the closed position, gives the outer container 2 a rectangular parallelepiped shape having a top wall and a bottom wall parallel and opposite to each other, a front wall and a rear wall (in which the hinge 9 is formed) parallel and opposite to each other, and two lateral walls parallel and opposite to each other. Between the lateral walls and the front and rear walls four longitudinal edges are defined, while between the top and bottom walls and the front, rear and lateral walls eight transverse edges are defined.

Figure 6:
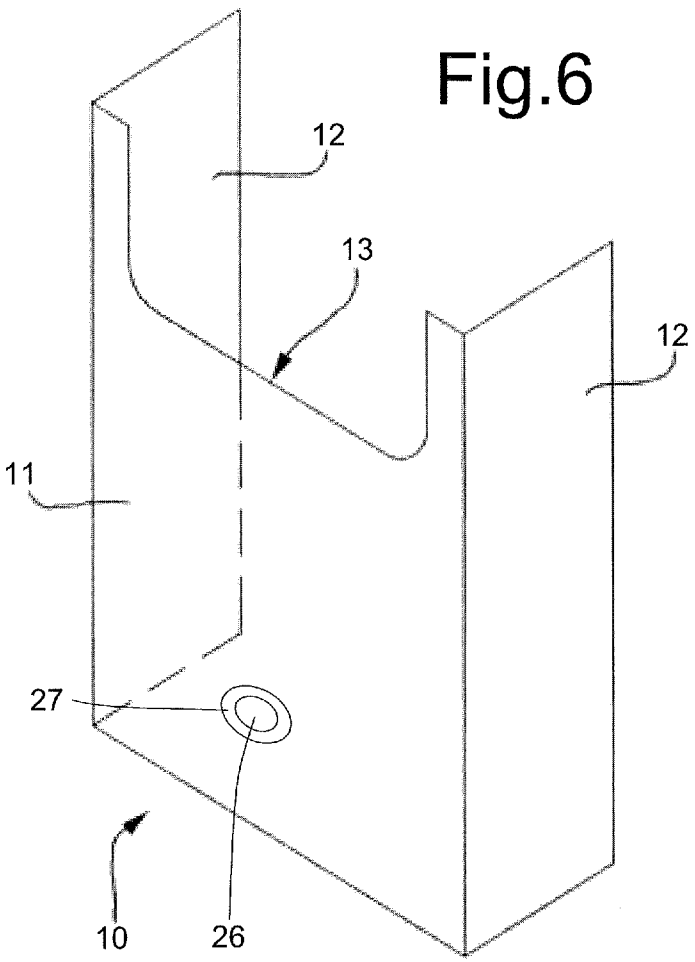
FIG. 6 is a front perspective view of a reinforcement element contained in the sealed wrap of FIG. 4.

As illustrated in FIG. 6, the sealed wrap 3 comprises a "U"-shaped reinforcement element 10, which is made of cardboard or rigid paperboard (quite similar to the cardboard or rigid paperboard forming the outer container 2) and is arranged on the inside of the sealed wrap 3 in contact with the group 4 of cigarettes. The reinforcement element 10 comprises a substantially rectangular-shaped front wall 11 which is arranged in contact with a front wall of the group 4 of cigarettes and two lateral walls 12, which are connected to opposite sides of the front wall 11 and are arranged in contact with the lateral walls of the group 4 of cigarettes. The front wall 11 has a "U"-shaped window which is arranged at the top, is defined by an edge 13 and facilitates the extraction of the cigarettes from the group 4 of cigarettes as it exposes a top area of the front wall of the group 4 of cigarettes.

The function of the reinforcement element 10 is to give greater rigidity and greater shape stability to the sealed wrap 3 in order to prevent the wrap 3 from collapsing on itself after extracting a part of the cigarettes contained in the same sealed wrap 3 thus complicating the extraction of the remaining cigarettes and complicating the opening and the subsequent re-closing of the sealing panel 6. An additional function of reinforcement element 10 is to provide adequate mechanical protection to the cigarettes during the forming and handling of the sealed wrap 3. Finally, another function of the reinforcement element 10 is to keep the lid 8 in the closed position, as the lid 8, to shift from the closed position to the open position (and vice versa), must slightly deform the top and front part of the reinforcement element 10 in an elastic manner.

Figure 7:
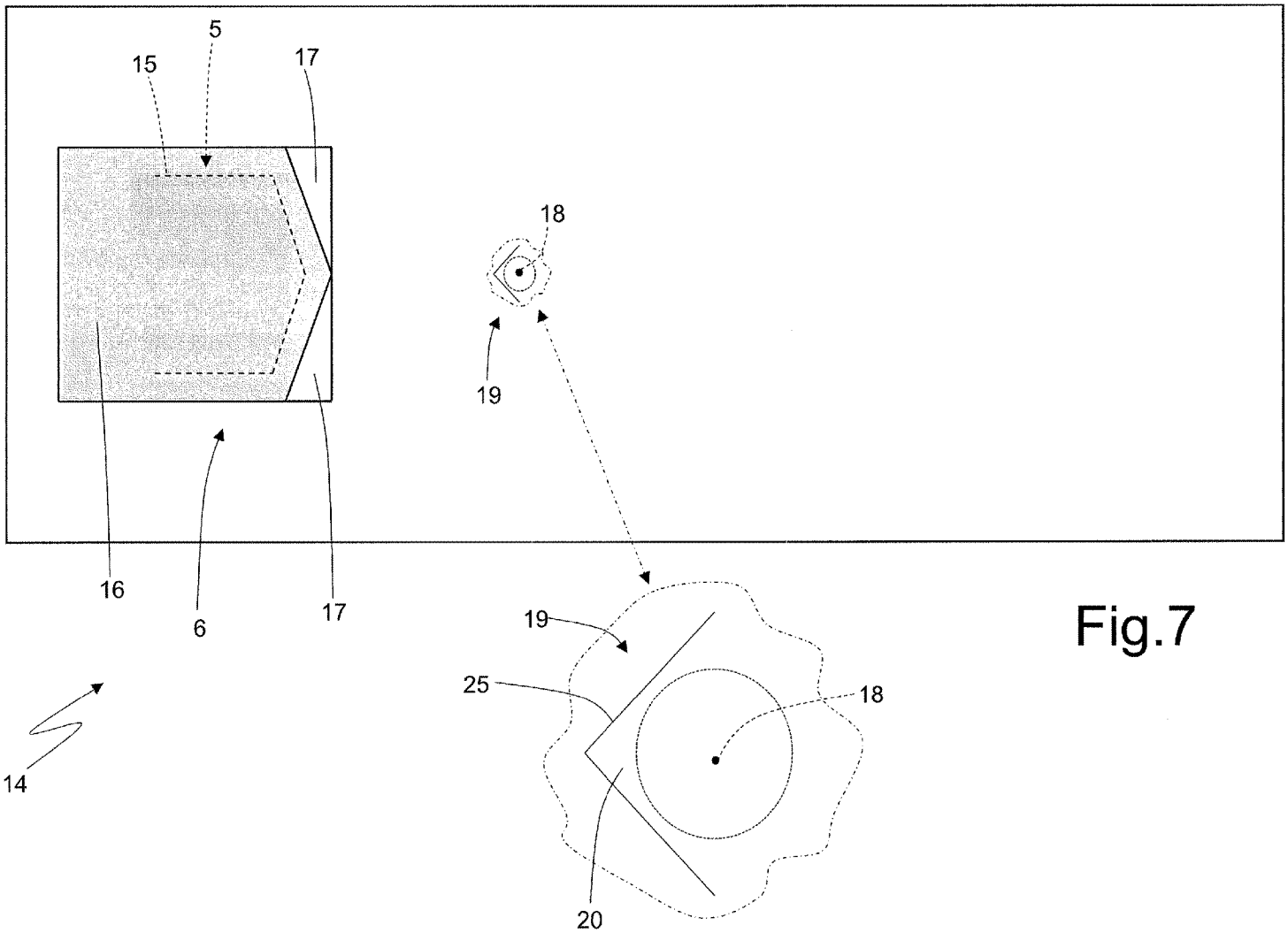
FIG. 7 is a plan view of a multilayer sheet of wrapping material used for producing the sealed wrap of FIG. 4.

As illustrated in FIG. 7, the sealed wrap 3 is obtained by folding a rectangular-shaped heat-sealable sheet 14 of wrapping material, which is folded about the group 4 of cigarettes enclosed in the reinforcement element 10 and once folded is stabilized by means of heat-sealing (i.e. overlapping portions of the sheet 14 of wrapping material are connected together in a stable manner by heat-sealing). The sheet 14 of wrapping material has a "U"-shaped incision 15 which defines the pull-out opening 5. The incision 15 can be a through incision from the beginning, i.e. from the beginning the incision 15 completely crosses through the thickness of the sheet 14 of wrapping material from side to side; in this embodiment, the air-tight seal of the sealed wrap 3 is ensured by the sealing panel 6 which completely covers the incision 15.

Alternatively, the incision 15 can be a non-through incision i.e. initially the incision 15 involves only a part of the thickness of the sheet 14 of wrapping material leaving totally integral a remaining part of the thickness of the sheet 14 of wrapping material; in this embodiment, the incision 15 is initially a non-through incision with respect to the sheet 14 of wrapping material and becomes a through incision (by tearing the remaining initially integral part of the sheet 14 of wrapping material) the first time the sealed wrap 3 is opened, i.e. only the first opening of the sealed wrap 3 (that is, the first raising of the sealing panel 6) causes the complete tearing of the sheet 14 of wrapping material along the incision 15. This embodiment, in which the incision 15 is initially a non-through incision, can be used both in conjunction with the sealing panel 6, and in the absence of the sealing panel 6, since the air-tight seal of the sealed wrap 3 is ensured by the fact that the incision 15 is initially a non-through incision; for example, in the absence of the sealing panel 6 a gripping tab can be glued to the pull-out opening 5 for raising the sheet 14 of wrapping material inside the incision 15, or the pull-out opening 5 can be glued to the inner surface of the front wall of the lid 8 to obtain an "automatic" opening of the pull-out opening 5 in combination with the opening of the lid 8.

Furthermore, the rectangular-shaped sealing panel 6 is glued to the sheet 14 of wrapping material and completely covers the incision 15 (i.e. the pull-out opening 5). Between the sealing panel 6 and the sheet 14 of wrapping material a pressure-sensitive repositionable adhesive 16 (i.e. that does not dry) is interposed, that allows to separate the sealing panel 6 from the sheet 14 of wrapping material also after a long period of time, and then to reunite the sealing panel 6 to the sheet 14 of wrapping material for numerous times.

The presence of the pressure-sensitive repositionable adhesive (i.e. which does not dry) between the sealing panel 6 and the sheet 14 of wrapping material causes a temporary glueing (that is, separated in use) between the portion of the sheet 14 of wrapping material surrounding the incision 15 (that is, surrounding the pull-out opening 5) and the sealing panel 6 so as to normally keep the sealing panel 6 in contact with the sheet 14 of wrapping material to close (seal) the pull-out opening 5. Moreover, the presence of the pressure-sensitive repositionable adhesive 16 (i.e. which does not dry) between the sealing panel 6 and the sheet 14 of wrapping material causes the functionally permanent glueing (that is, never separated also in use) of the portion of the sheet 14 of wrapping material, enclosed by the incision 15 (i.e. at the pull-out opening 5), to the sealing panel 6; therefore, when the sealing panel 6 is raised from the sheet 14 of wrapping material the portion of the sealing panel 6 enclosed by the incision 15 (that is, at the extraction opening 5) is raised together with the sealing panel 6 freeing the pull-out opening 5. Obviously, it is also possible to use non-separable permanent adhesive (i.e. that dries) which is interposed between the sealing panel 6 and the sheet 14 of wrapping material inside the incision 15 (that is, at the pull-out opening 5) in order to strengthen the mechanical connection between these two parts; the presence of non-separable permanent adhesive between the sealing panel 6 and the sheet 14 of wrapping material inside the incision 15 (that is, at the pull-out opening 5) is required when the incision 15 is initially a non-through incision to overcome the tear-off resistance of the initially non-through incision 15.

The sealing panel 6 is provided with two gripping tabs 17, each of which is free from pressure-sensitive repositionable adhesive 16 (i.e. that does not dry) on the side facing the sheet of packing material 14 (that is, on the surface in front of the sheet 14 of wrapping material) and it is arranged near the pull-out opening 5 and below the pull-out opening 5 itself. Each gripping tab 17 is suited to facilitate the grip of the sealing panel 6 when the sealing panel 6 itself is raised; in other words, to raise the sealing panel 6, a user can easily grip a gripping tab 17, which is in no way fixed to the sheet 14 of wrapping material in contrast to the rest of the sealing panel 6.

Figure 4:
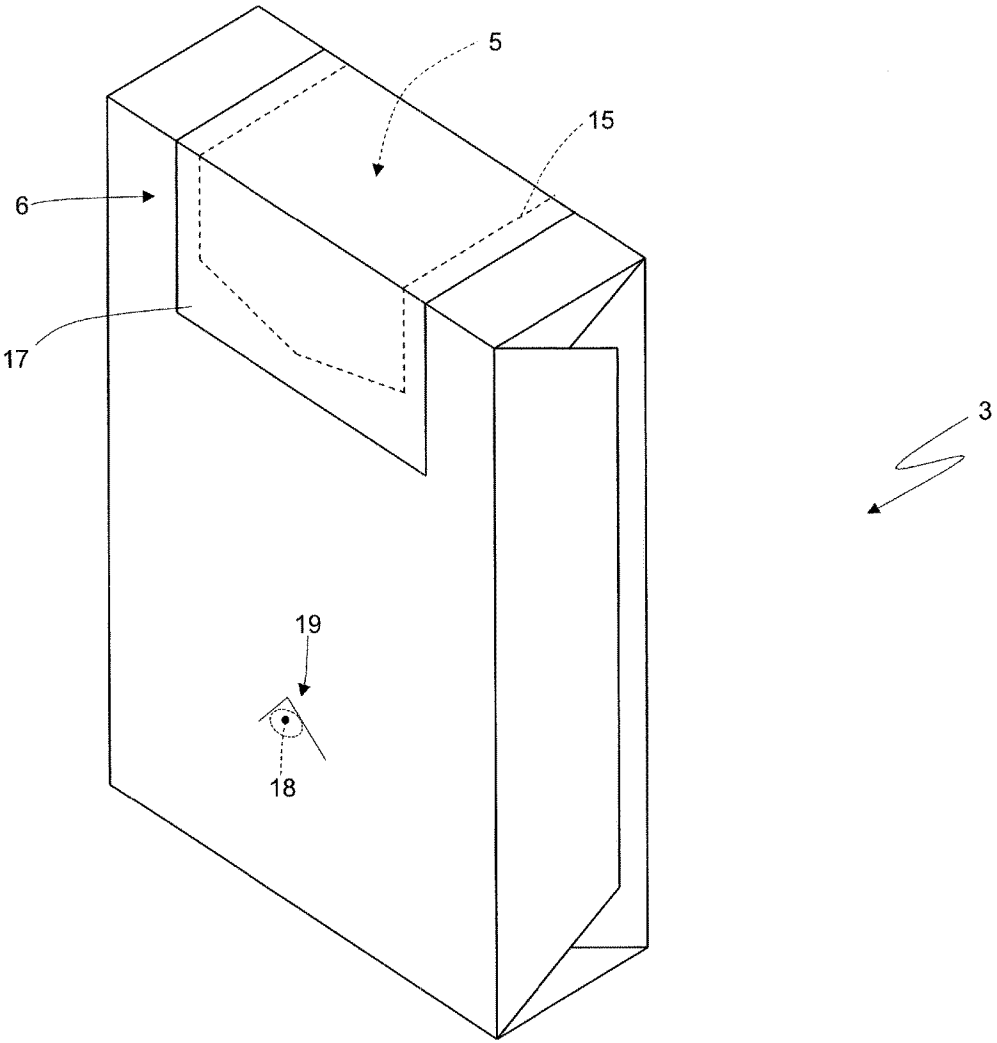
FIG. 4 is a front perspective view of the sealed wrap of the packet of FIG. 1.
Figure 5:
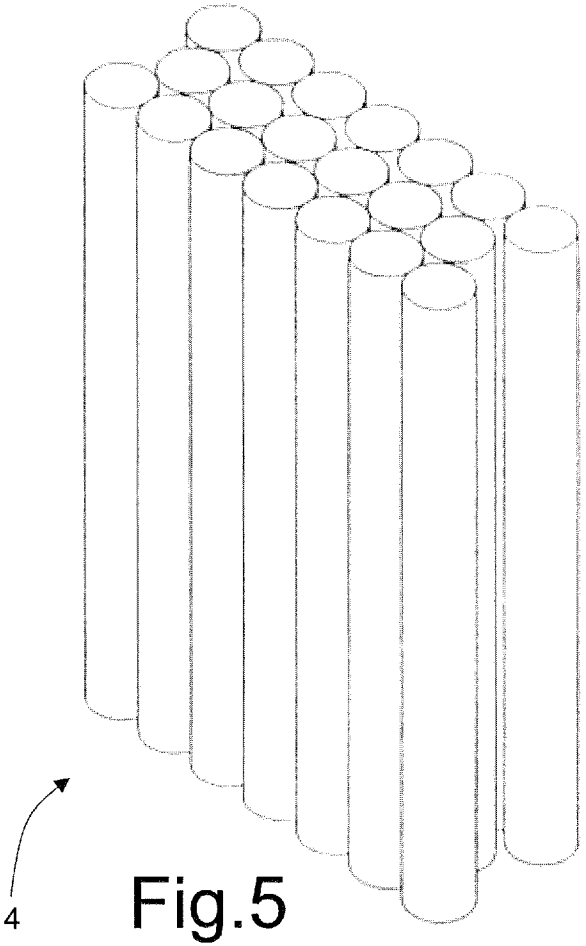
FIG. 5 is a front perspective view of a group of cigarettes contained in the sealed wrap of FIG. 4.

As illustrated in FIG. 4, the sealed wrap 3 comprises a passage hole 18, which is formed through a front wall of the sealed wrap 3 to allow suction of part of the air contained inside the sealed wrap 3 so as to depressurize the sealed wrap itself. In the embodiment illustrated in FIG. 4, the passage hole 18 is formed through the front wall of sealed wrap 3, but it is clear that the passage hole 18 can be formed in any other wall (top, bottom, lateral, rear) of the sealed wrap 3; in any case, it is preferable that the passage hole 18 is formed at the reinforcement element 10, i.e. in an area of the sealed wrap 3 resting on the underlying reinforcement element 10. In fact, during the suction of part of the air contained inside the sealed wrap 3, a suction device rests with a certain mechanical pressure on the sealed wrap 3 around the passage hole 18 and therefore the presence of the underlying reinforcement element 10 at the passage hole 18 prevents the mechanical pressure exerted by the suction device from damaging the cigarettes contained inside the sealed wrap (i.e. the reinforcement element 10 protects the cigarettes contained inside the sealed wrap 3 from the mechanical pressure exerted by the suction device).

Furthermore, the sealed wrap 3 comprises a one-way pneumatic valve 19 that overlaps the passage hole 18 and has the function of keeping the passage hole 18 normally isolated from the external environment in order to not allow any gas passage between the sealed wrap 3 and the external environment. The pneumatic valve 19 is normally closed (i.e. normally seals air-tight the passage hole 18, isolating the passage hole 18 from the outside environment) and is temporarily open (i.e. allowing free communication between the passage hole 18 and the external environment) only and just during the suction step of the air contained inside the sealed wrap 3 to depressurize the sealed wrap 3 itself.

As illustrated in FIGS. 8-11, the pneumatic valve 19 comprises a valve element 20, which is movable between a closed position (illustrated in FIGS. 8 and 10) in which the passage hole 18 is sealed air-tight, isolating the passage hole 18 from the external environment, and an open position (illustrated in FIG. 9) wherein it allows free communication between the passage hole 18 and the external environment.

Figure 8:
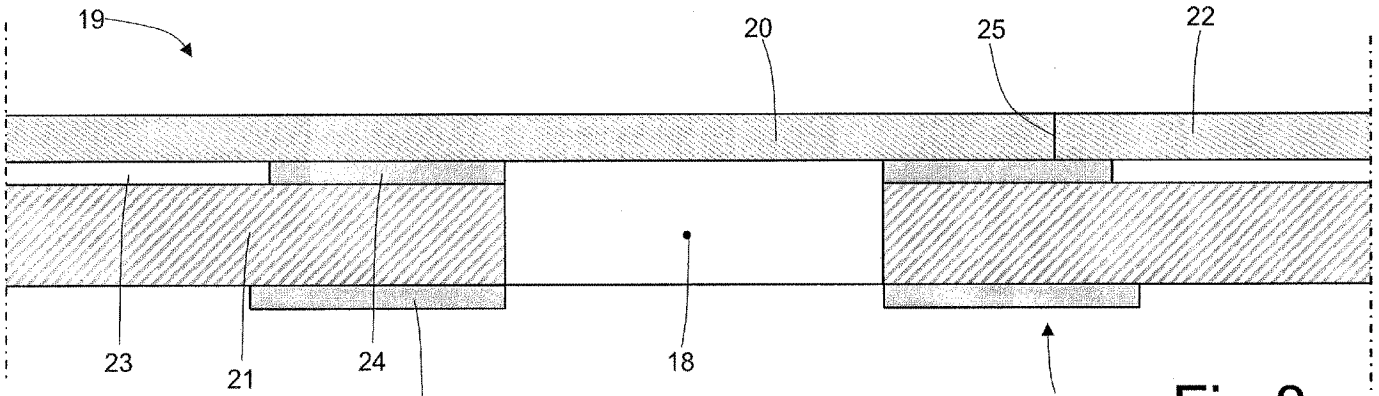
FIGS. 8 and 9 are two different sectional views of a passage hole and of a corresponding pneumatic valve formed in the multilayer sheet of wrapping material of FIG. 7 respectively in a closed position and in an open position of the passage hole.
Figure 9:
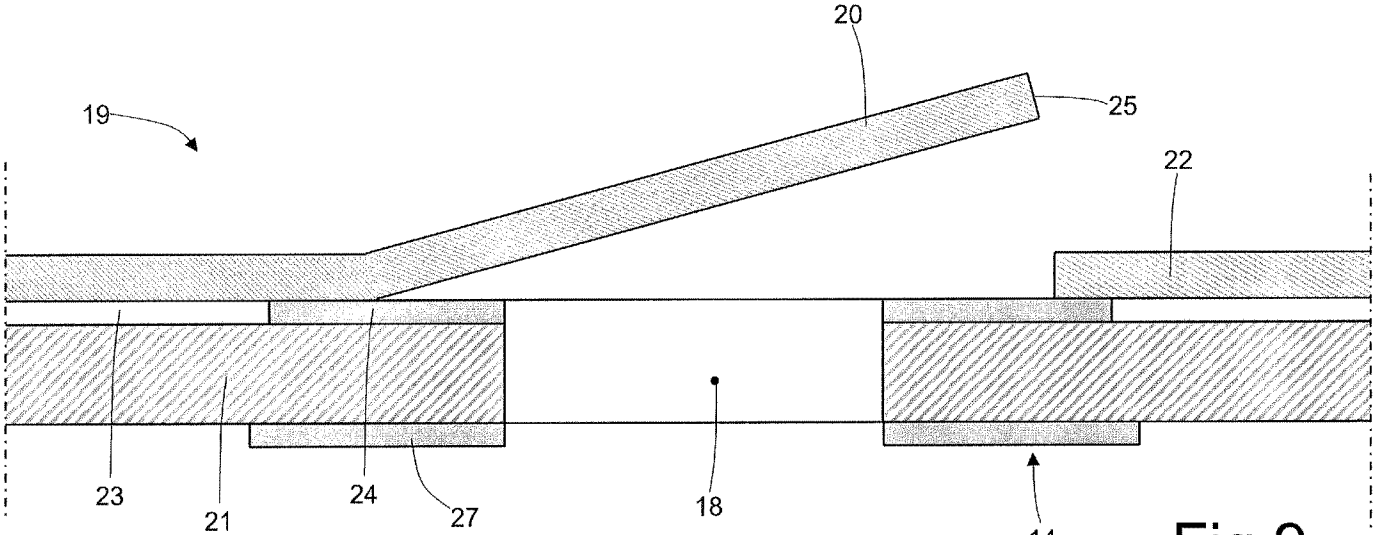
Figure 11:
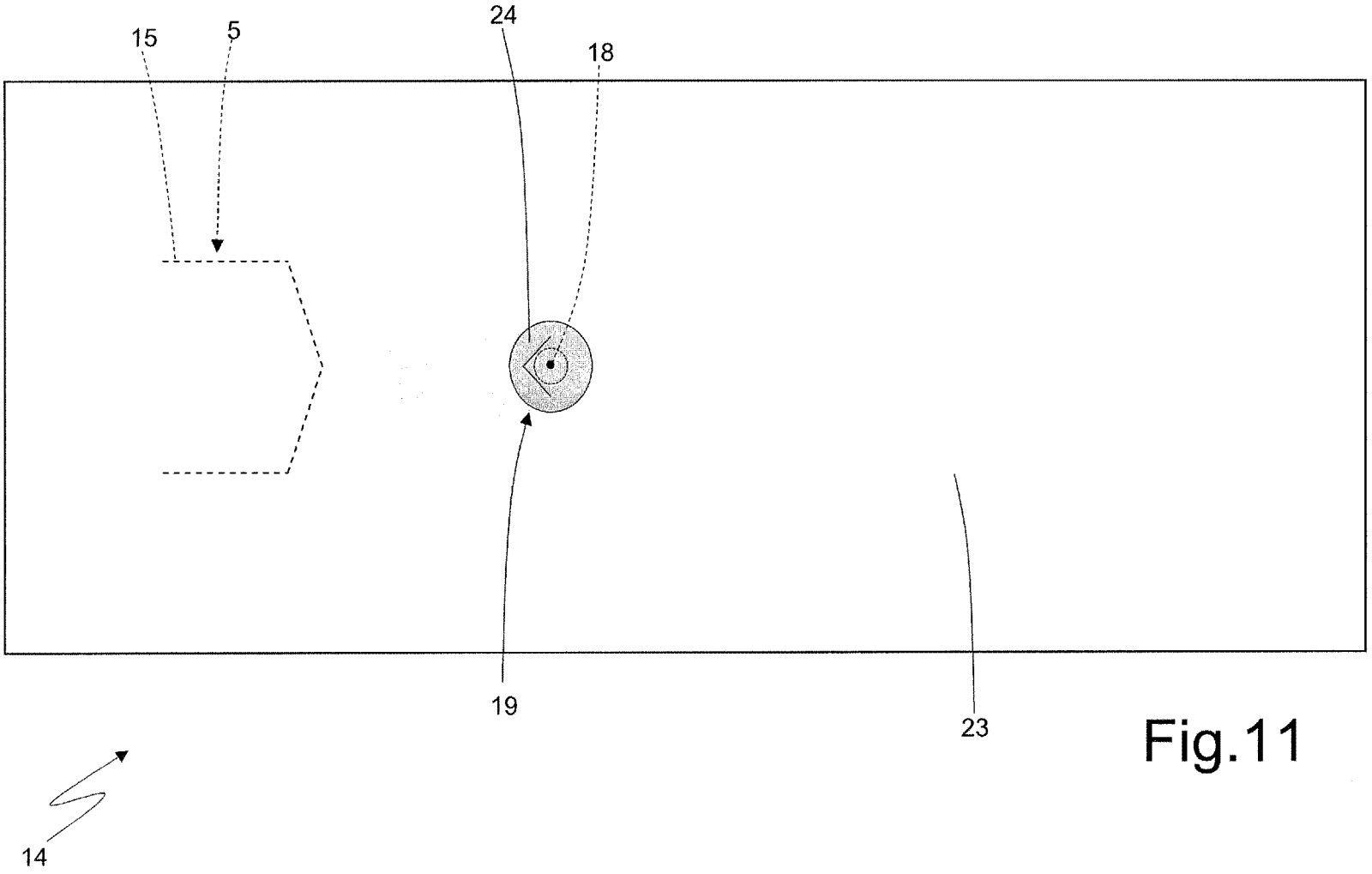
FIG. 11 is a plan view of the multilayer sheet of wrapping material of FIG. 7 emphasizing two different types of adhesives interposed between two layers of the multilayer sheet of the wrapping material itself.

As illustrated in FIGS. 8 and 9, the sheet 14 of wrapping material is of multilayer type and comprises an inner layer 21 of plastic material (of thermoplastic type to be heat-sealable) and an outer layer 22 of plastic material (of thermoplastic type to be heat-sealable) which overlap and are glued to each other and both extend seamless over the whole surface of the sheet 14 of wrapping material. Between the two layers 21 and 22 a non-separable permanent adhesive 23 is interposed, that, as illustrated in FIG. 11, extends over the whole sheet 14 of wrapping material except for the area in which the valve element 20 is located (i.e. except for the area where the pneumatic valve 19 is located); the permanent adhesive 23 is an adhesive that dries and therefore once dried (i.e. shortly after its application) does not allow any separation (if not after a final and non reassemblable breakage) between the two layers 21 and 22. In the area where the valve element 20 is located (i.e. the area in which the pneumatic valve 19 is located), between the two layers 21 and 22 a pressure-sensitive repositionable adhesive 24 (i.e. which does not dry and therefore of the same type of the repositionable adhesive 16 used for the sealing panel 6) is interposed that allows even after a long time to locally separate the two layers 21 and 22 and then to reunite the two layers 21 and 22 for numerous times.

Figure 10:
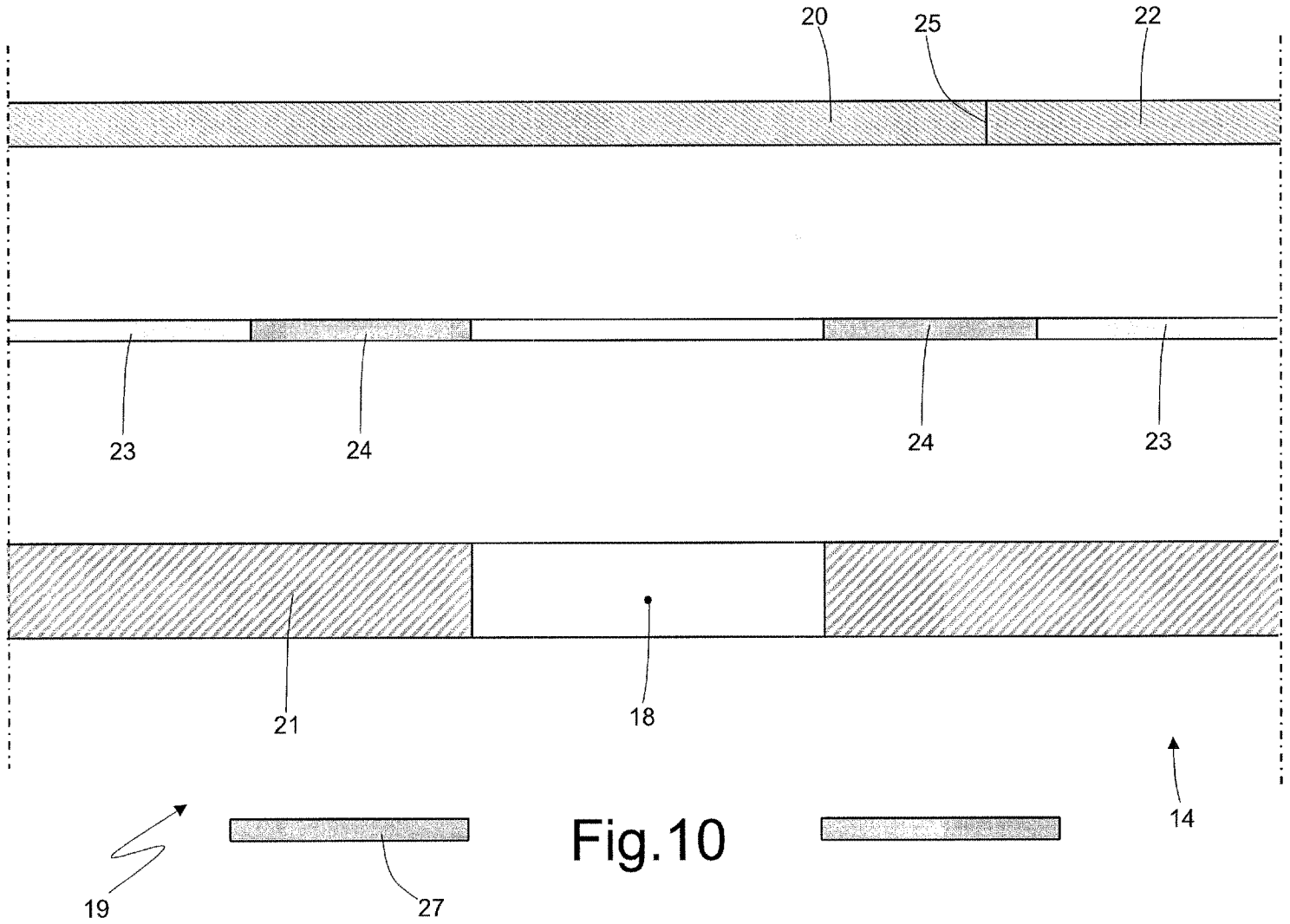
FIG. 10 is a sectional and exploded view of the multilayer sheet of wrapping material of FIG. 7 at the passage hole and of the corresponding pneumatic valve of FIGS. 8 and 9.

As better illustrated in FIGS. 8, 9 and 10, the passage hole 18 is formed only through the inner layer 21 of the sheet 14 of wrapping material; i.e. the passage hole 18 passes through the inner layer 21 of the sheet 14 of wrapping material and does not involve in any way the outer layer 22 of the sheet 14 of wrapping material. Furthermore, the valve element 20 of the pneumatic valve 19 consists of a portion of the outer layer 22 (and only of the outer layer 22) which is separated from the remaining part of the outer layer 22 by a "U"-shaped through incision 25 and is connected to the underlying inner layer 21 by means of the repositionable adhesive 24. In the embodiment illustrated in the accompanying figures the "U"-shaped through incision 25 forms a sharp edge at the cusp (as illustrated in FIG. 7), but according to alternative and completely equivalent embodiments the "U"-shaped through incision 25 can have a rounded shape at the cusp, or can be shaped as a fractured line formed by the union of several straight segments angled one with respect to the other.

Usually, the repositionable adhesive 24 which is located at the pneumatic valve 19 keeps the valve element 20 of the pneumatic valve 19 in close contact with the underlying layer 21 of the inner sheet 14 of wrapping material by sealing air-tight$_{13}$ the passage hole 18, i.e. by isolating the passage hole 18 from the external environment (as illustrated in FIG. 8). When an adequate uplifting force (typically by suction effect or by means of mechanical action) is applied to the valve element 20 of the pneumatic valve 19, the valve element 20 of the pneumatic valve 19 is raised from the underlying inner layer 21 of the sheet 14 of wrapping material (and therefore the repositionable adhesive 24 stops its binding action) allowing free communication between the passage hole 18 and the external environment (as illustrated in FIG. 9); when the uplifting force acting on the valve element 20 of the pneumatic valve 19 stops, the valve element 20 rests again on the underlying inner layer 21 of the sheet 14 of wrapping material (as illustrated in FIG. 8 and optionally with the aid of a mechanical presser) causing a new closing of the pneumatic valve 19 due to the binding action of the repositionable adhesive 24.

In the embodiment described above, there is only one passage hole 18 having relatively large sizes and the pneumatic valve 19 has a single valve element 20 which is coupled directly to the passage hole 18 (i.e. overlaps the passage hole 18). According to an alternative and perfectly equivalent embodiment, there are multiple passage holes 18 having smaller sizes and the pneumatic valve 19 has more valve elements 20, each of which is coupled directly to a corresponding passage hole 18 (i.e. overlaps the passage hole 18). According to a further and perfectly equivalent embodiment, there is only one passage hole 18 having relatively large sizes and the pneumatic valve 19 has more valve elements 20, each of which is arranged around the passage hole 18 (i.e. the valve elements 20 are uniformly distributed around the passage hole 18).

In the embodiment described above, the adhesive 24 which is located at the pneumatic valve 19 is a pressure-sensitive repositionable adhesive (i.e. which does not dry); in this embodiment, the pneumatic valve 19 is multi-purpose, i.e. can be used many times as it is possible to switch several times from the closed position to the open position and vice versa. According to an alternative embodiment, the adhesive 24 which is located at the pneumatic valve 19 is an adhesive which is initially inactive and is activated by heat, i.e. is an adhesive that at the first application does not cause any type of glueing between the two layers 21 and 22 of sheet 14 of wrapping material and which can be activated by heating in order to cause permanent glueing (i.e. no longer separable if not by non reassemblable breakage) between the two layers 21 and 22 of sheet 14 of wrapping material; in this embodiment, the pneumatic valve 19 is disposable, or may be used only once because once the adhesive 24 is activated by heating it is no longer possible to re-open the pneumatic valve 19 itself.

As previously stated, the passage hole 18 is formed through the front wall of the sealed wrap 3, and then overlaps the front wall 11 of the reinforcement element 10. The reinforcement element 10 may be free from holes at the passage hole 18, as in any case by sucking air through the passage hole 18 the air reaches the passage hole 18 flowing in the space formed between the inner surface of the sealed wrap 3 and the outer surface of the reinforcement element 10; however, in this embodiment it is necessary to apply a larger suction depression to overcome the pressure loss generated by the "tortuous" path followed by the air inside the sealed wrap 3 in order to reach the passage hole 18. According to a preferred embodiment illustrated in dashed lines in FIG. 6, the front wall 11 of the reinforcement element 10 has a through hole 26, which is arranged at the passage hole 18 (i.e. is aligned with the passage hole 18) and it allows a more direct airflow inside the sealed wrap 3 towards the passage hole 18.

According to a preferred embodiment illustrated in FIG. 6 and in FIGS. 8, 9 and 10, around the through hole 26 of the reinforcement element 10 a non-separable permanent adhesive 27 is applied which causes a locally permanent glueing between the sheet 14 of wrapping material and the underlying reinforcement element 10 (i.e. between the bottom face of the inner layer 21 of the sheet 14 of wrapping material and the top face of the front wall 11 of the reinforcement element 10). The function of permanent adhesive 27 is to bind the inner layer 21 of the reinforcement element 10 to the underlying sheet 14 of wrapping material at the pneumatic valve 19 (i.e. around the through hole 26 of the reinforcement element 10) in such a way that when an uplifting force is applied to the valve element 20 of the pneumatic valve 19, only the valve element 20 of the pneumatic valve 19 raises from the underlying layer 21 of the inner sheet 14 of wrapping material. In other words, in the absence of the permanent adhesive 27 when an uplifting force is applied to the valve element 20 of the pneumatic valve 19 the entire sheet 14 of wrapping material (i.e. both the valve element 20 of the pneumatic valve 19, and the underlying inner layer 21) could be raised without therefore causing the desired separation between the valve element 20 of the pneumatic valve 19 and the underlying inner layer 21 of the sheet 14 of wrapping material; whereas, the presence of the permanent adhesive 27 mechanically binds the inner layer 21 of the sheet 14 of wrapping material to the underlying reinforcement element 10 preventing the inner layer 21 of the sheet 14 of wrapping material from raising up and thus allowing the pneumatic valve 19 to open properly when an uplifting force is applied to the valve element 20 of the pneumatic valve 19.

According to a preferred, but non-limiting, embodiment, the passage hole 18 is formed through the inner layer 21 of the sheet 14 of wrapping material before uniting together the two layers 21 and 22 of sheet 14 of wrapping material; in the same way, the through incision 25 which defines the valve element 20 is formed through the outer layer 22 of the sheet 14 of wrapping material before uniting together the two layers 21 and 22 of sheet 14 of wrapping material. In this way, forming the passage hole 18 and the through incision 25 is extremely simple and can be performed by routine mechanical operations. It is important to note that when the two layers 21 and 22 of the sheet 14 of wrapping material are overlapped, a high precision is not required in the relative positioning between the passage hole 18 and the through incision 25 that defines the valve element 20, as small deviations do not alter in any way the functionality of the pneumatic valve 19.

Alternatively, the passage hole 18 and the through incision 25 can be made on the sheet 14 of wrapping material after the two layers 21 and 22 are united together; in this case, it is necessary to use laser processing that allows the high precision cutting of only part of the overall thickness of the sheet 14 of wrapping material.

In the embodiment illustrated in FIGS. 7-11, the one-way pneumatic valve 19 allows only a flow of gas from inside the sealed wrap 3 towards the external environment to depressurize the sealed wrap 3 itself, i.e. the one-way pneumatic valve 19 allows only to suck some of the air contained inside the sealed wrap 3 to depressurize the sealed wrap 3 itself. Therefore, the one-way pneumatic valve 19 is used to impart an inner pressure lower than atmospheric pressure (i.e. environmental pressure) to the sealed wrap 3; in particular, the one-way pneumatic valve 19 is used to suck part of the air contained inside the sealed wrap 3 and therefore depressurize the sealed wrap 3 itself. Preferably the vacuum inside the sealed wrap 3 (i.e. the pressure variation between the inside of the sealed wrap 3 and the atmospheric pressure) is less than 0.05 bar and generally comprised between 0.01 bar and 0.02 bar. It is important to note that the greater the mechanical protection of the group 4 of cigarettes is, as ensured by the reinforcement element 10, the greater the vacuum inside the sealed wrap 3 can be; to increase the mechanical protection of the group 4 of cigarettes ensured by the reinforcement element 10 (therefore to increase the vacuum inside the sealed wrap 3), the reinforcement element 10 could also be provided with a rear wall which gives the reinforcement element 10 a tubular shape having overall a greater_mechanical strength.

Figure 12:
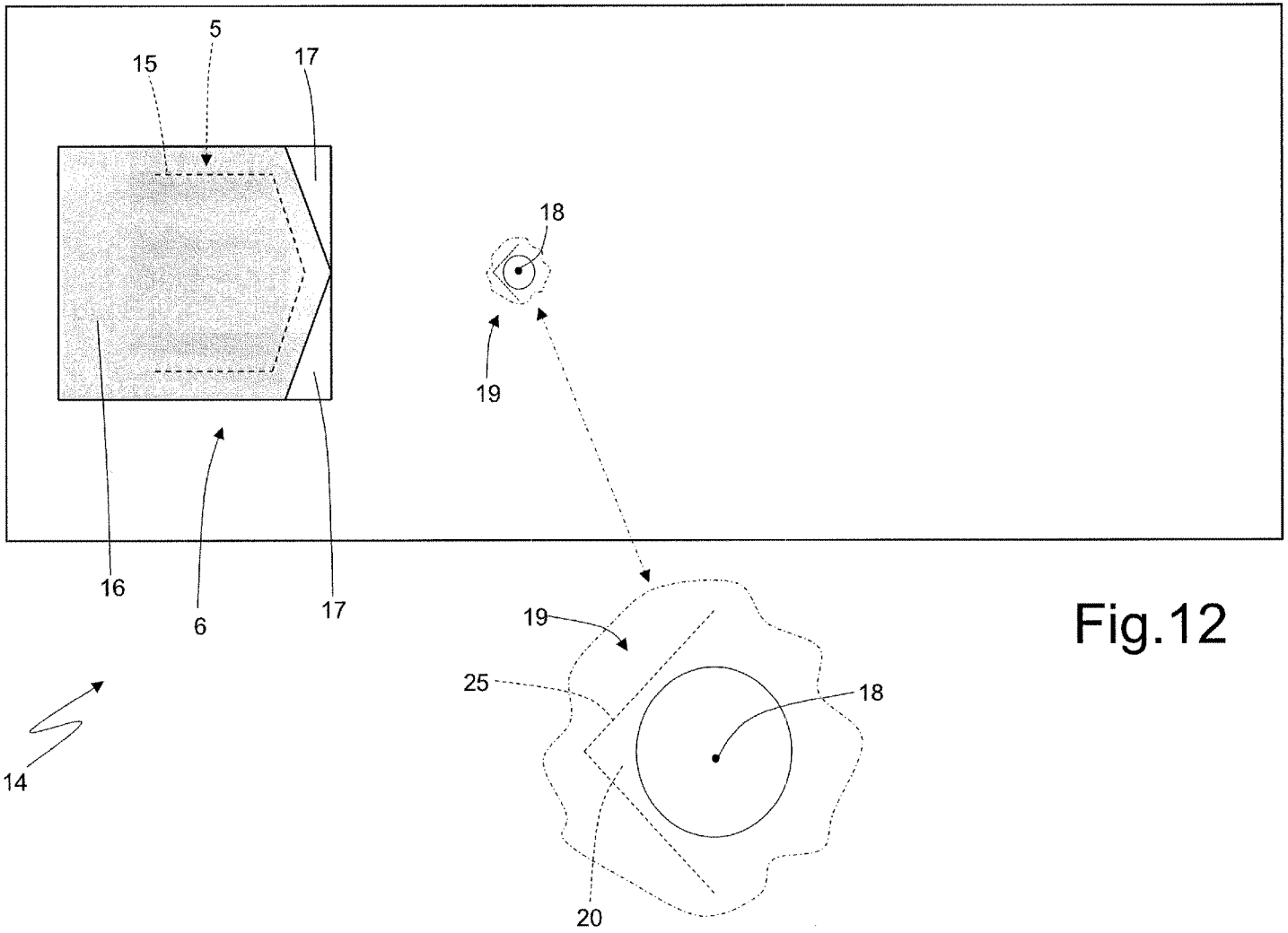
FIG. 12 is a plan view of an alternative of the multilayer sheet of wrapping material of FIG. 7.
Figure 13:
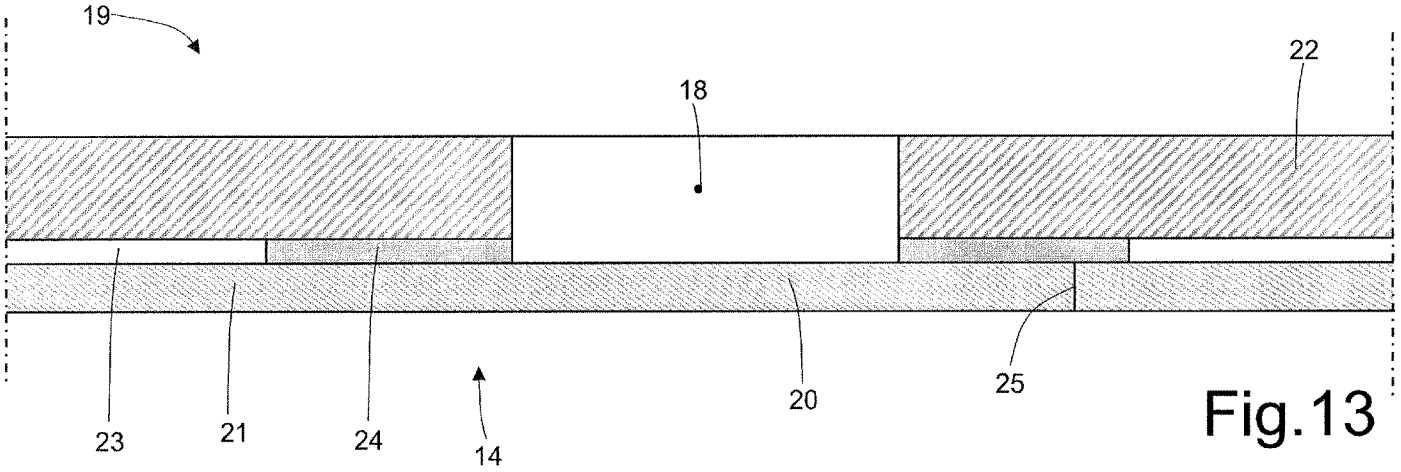
FIGS. 13 and 14 are two different sectional views of a passage hole and of a corresponding pneumatic valve formed in the multilayer sheet of wrapping material of FIG. 12 in a closed position and in an open position of the passage hole, respectively.
Figure 14:
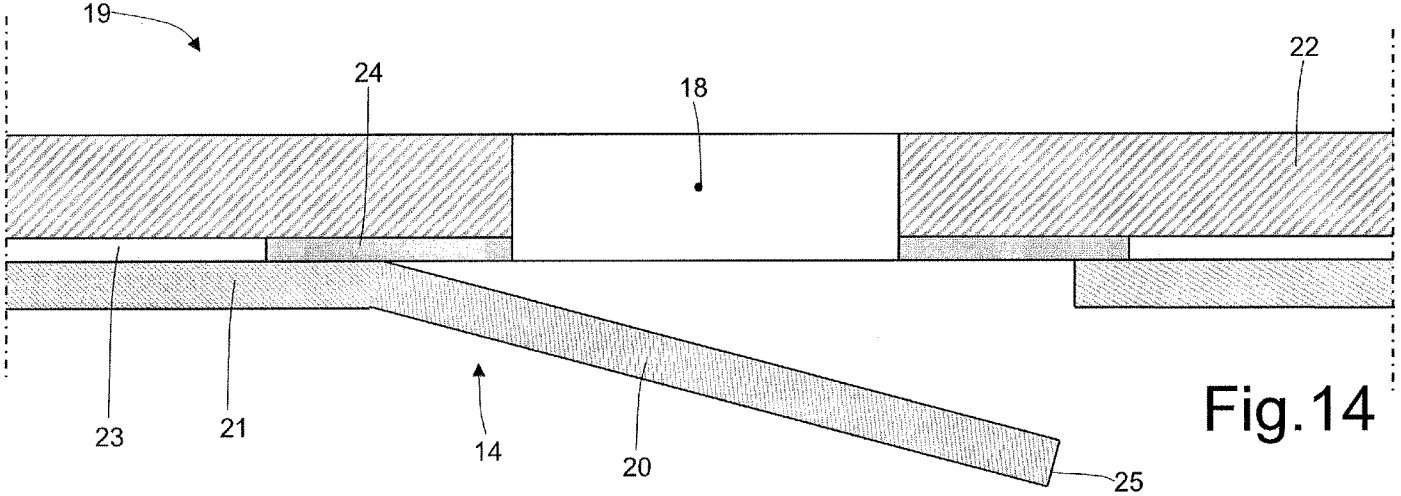

In the alternative embodiment illustrated in FIGS. 12-14, the one-way pneumatic valve 19 is "inverted", i.e. allows only a flow of gas from the external environment towards the inside of the sealed wrap 3 to pressurize the sealed wrap 3, i.e. the one-way pneumatic valve 19 allows only to pump a gas (typically inert such as nitrogen) inside the sealed wrap 3 to pressurize the sealed wrap 3. Therefore, the one-way pneumatic valve 19 is used to impart an inner pressure higher than the atmospheric pressure (i.e. environmental pressure) to the sealed wrap 3. Typically, in the sealed wrap 3 an inert gas is pumped (for example nitrogen, argon or carbon dioxide) until the desired overpressure is reached; sterilizing and/or aromatizing compounds can be added to the inert gas (for example comprising menthol aroma, tobacco aroma, coffee aroma, anise aroma). Preferably the pressurization inside the sealed wrap 3 (i.e. the pressure variation between the inside of the sealed wrap 3 and the atmospheric pressure) is less than 0.15 bar and generally comprised between 0.05 bar and 0.10 bar.

In the embodiment illustrated in FIGS. 7-11, the passage hole 18 is formed only through the inner layer 21 of the sheet of wrapping material; i.e. the passage hole 18 passes through the inner layer 21 of the sheet 14 of wrapping material and does not involve in any way the outer layer 22 of the sheet 14 of wrapping material. Whereas, in the embodiment illustrated in FIGS. 7-11, the passage hole 18 is formed only through the outer layer 22 of the sheet 14 of wrapping material; i.e. the passage hole 18 passes through the outer layer 22 of the sheet 14 of wrapping material and does not involve in any way the inner layer 21 of the sheet 14 of wrapping material.

In the embodiment illustrated in FIGS. 7-11, the valve element 20 of the pneumatic valve 19 consists of a portion of the outer layer 22 (and only of the outer layer 22) which is separated from the remaining part of the outer layer 22 by a "U"-shaped through incision 25 and is connected to the underlying inner layer 21 by means of the repositionable adhesive 24. Whereas, in the embodiment illustrated in FIGS. 7-11, the valve element 20 of the pneumatic valve 19 consists of a portion of the inner layer 21 (and only the inner layer 21) which is separated from the remaining part of the inner layer 21 by the "U"-shaped through incision 25 and is connected to the overlying outer layer 22 by means of the repositionable adhesive 24.

In the embodiment illustrated in FIGS. 7-11, the outer layer 22 of the sheet 14 of wrapping material has a thickness lower than the thickness of the inner layer 22 as, in this way, the valve element 20 of the pneumatic valve 19 has a lower mechanical inertia and a greater ease of deformation that make operating thereof more effective. Similarly, in the embodiment illustrated in FIGS. 7-11 the outer layer 22 of the sheet 14 of wrapping material has a thickness greater than the thickness of the inner layer 21.

In the embodiments described above, the depressurization or the pressurization of the sealed wrap 3 are obtained by means of corresponding pneumatic valves 19 through which a gas passage (out-coming or incoming) is obtained through the sealed wrap 3. According to a different embodiment, the sealed wrap 3 is completely free from pneumatic valves 19 and the depressurization or the pressurization of the sealed wrap 3 are obtained by means of an active element that is inserted inside the sealed wrap 3 before the sealed wrap 3 itself is completely closed and that slowly absorbs (i.e. in a few seconds, a few minutes or a few hours) a quantity of the gases contained inside the sealed wrap 3 (to depressurize the sealed wrap 3) or slowly releases (i.e. in a few seconds, a few minutes or a few hours) gases in the sealed wrap 3 (to pressurize the sealed wrap 3).

For example the active element could consists of an inert gas in the liquid state (liquid nitrogen, liquid argon) or in the solid state (dry ice i.e. solid carbon dioxide) that is initially cold (i.e. considerably colder than environmental temperature and at a below zero temperature) and by warming (due to the environmental heat), inside the sealed wrap 3, vaporizes thereby increasing the inner pressure of the sealed wrap 3 itself. In this case the active element is inserted in the sealed wrap 3 immediately before the final sealing (i.e. immediately upstream from the welder that performs the final sealing).

Alternatively, the active element could consist of a substance which, in contact with oxygen, oxidize (i.e. combines with oxygen) by means of a chemical reaction which can generate a greater volume of gas with respect to the initial state (to pressurize the sealed wrap 3) or can produce a smaller volume of gas with respect to the initial state (to depressurize the sealed wrap 3); said embodiment allows to repeat pressurization/depressurization of the sealed wrap 3 at each opening (and subsequent closing) of the sealed wrap 3: in fact at every opening (and subsequent closing) of the sealed wrap 3 new oxygen enters inside the sealed wrap 3 allowing to repeat the chemical reaction that pressurizes/depressurizes the sealed wrap 3. For example, the active element may comprise the so called "oxygen scavengers", i.e. elements capable of spontaneously oxidizing and thus capture the molecular oxygen content inside the sealed wrap 3 (for example, oxygen scavengers most used in the food sector are iron based). In other words, an oxygen scavenging element is inserted inside the sealed wrap 3 that after the air-tight closing of the sealed wrap 3 and slowly (i.e. in a time frame of minutes or tens of minutes), consumes at least part of the molecular oxygen contained inside the sealed wrap 3 itself thus reducing the inner pressure of the sealed wrap 3. In this case, the active element can be contained in a separate insertion which is introduced inside the sealed wrap 3, or it can be carried by the reinforcement element 10 and/or by the inner surface of the sheet 14 of wrapping material (in this case, the oxygen scavenging element is applied by means of surface treatment, also by nano-technology, of the reinforcement element 10 and or of the inner surface of the sheet 14 of wrapping material).

According to a possible embodiment, in the sealed wrap 3 a volatile aromatic substance (for example tobacco aroma) can be inserted which is progressively released inside the sealed wrap 3 and comes out of from the sealed wrap 3 the first time the sealed wrap 3 is opened. Preferably (but not exclusively), the volatile aromatic substance is inserted in the sealed wrap 3 when the inner pressure of the sealed wrap 3 is higher than the atmospheric pressure (i.e. environmental pressure), because in this way the first time the sealed wrap 3 is opened a significant part of the gases contained inside the sealed wrap 3 comes out due to the inner overpressure of the sealed wrap 3 thus diffusing around the packet 1 of cigarettes a significant quantity of volatilized aromatic substance; consequently, the first time the sealed wrap 3 is opened the user perceives a very strong out-coming aroma from the packet of cigarettes, receiving a highly positive sensation. In other words, the first time the sealed wrap 3 is opened the inner overpressure of the sealed wrap 3 operates as an efficient and effective diffuser of the volatilized aromatic substance contained in the sealed wrap 3. This solution is particularly advantageous when the sealed wrap 3 receives not a group 4 of conventional cigarettes but a group of other tobacco articles which have a limited (if compared with the fragrance of conventional cigarettes) or totally absent fragrance.

The volatile aromatic substance can be pumped into the sealed wrap 3 in a gaseous state when overpressure is obtained or can be inserted in the sealed wrap 3 in a liquid or solid state to obtain a volatilization (relatively slow) of the aromatic substance in the sealed wrap 3. For example, the aromatic substance may be sprayed in a liquid state on the sheet 14 of wrapping material immediately before folding the sheet 14 of wrapping material around the group 4 of cigarettes, it can be impregnated into the reinforcement element 10 (which, being made of cardboard, is permeable and particularly appropriate for absorbing the volatile aromatic substance in the liquid state), or it may be impregnated into a permeable support that is coupled to the group 4 of cigarettes before folding the sheet 14 of wrapping material around group 4 of cigarettes.

When the sealed wrap 3 is internally provided with a different pressure than the atmospheric pressure (i.e. environmental pressure), the sealed wrap 3 itself undergoes a deformation due to the differential between its inner pressure and the atmospheric pressure (i.e. the pressure of the external environment): in particular when the sealed wrap 3 is depressurized the atmospheric pressure forces the sealed wrap to adhere to its own content (i.e. to the group 4 of cigarettes) by compressing its content, whereas when the sealed wrap 3 is pressurized the sealed wrap 3 itself inflates. Said deformations of the sealed wrap 3 due to the pressure differential between the inner sealed wrap 3 and atmospheric pressure could give the sealed wrap 3 itself a relatively unpleasant look and therefore it may be convenient to limit said deformations.

One possibility for limiting the deformations of the sealed wrap 3 due to the pressure differential is to mechanically bind (typically by means of glueing but also possibly by heat-sealing) some parts of the sealed wrap 3 (obviously externally to the pull-out opening 5) to the reinforcement element 10 and/or to the outer container 2 (obviously not to the lid 8); in this way the effective length of the sealed wrap 3 is reduced and in this way the possibility of deformation of the sealed wrap 3 is significantly reduced. For example the front wall (externally to the pull-out opening 5) and/or the lateral walls of the sealed wrap 3 may be mechanically bound (glued or heat sealed) respectively to the front wall 11 and to the lateral walls 12 of the reinforcement element 10; in addition or alternatively, the front wall, the lateral walls and/or the rear wall of the sealed wrap 3 can be mechanically bound (glued or heat sealed) to the corresponding walls of the outer container 2. In the case in which the reinforcement element 10 comprises also a top wall, the top wall of the sealed wrap 3 (externally of the pull-out opening 5) can be mechanically bound (glued or heat sealed) to the top wall of the reinforcement element 10.

A further possibility to limit the deformations of the sealed wrap 3 due to the pressure differential is to thermo-shrink the sealed wrap 3 after the construction of the sealed wrap 3 is completed; in this way the effective length of the sealed wrap 3 is reduced and therefore the possibility of deformation of the sealed wrap 3 is reduced. Obviously, the thermo-shrinkage of the sealed wrap 3 must be limited to not overly compress the group of cigarettes 4, i.e. to avoid damaging the group 4 of cigarettes; in this regard it should be noted that the reinforcement element 10 which embraces the group 4 of cigarettes provides a certain mechanical protection to cigarettes and thus allows to slightly heat-shrink the sealed wrap 3 without taking the risk of damaging the group 4 of cigarettes. To increase the mechanical protection of the group 4 of cigarettes, the reinforcement element 10 could also have a rear wall which gives the reinforcement element 10 itself a tubular shape having an overall greater mechanical strength.

Figure 15:
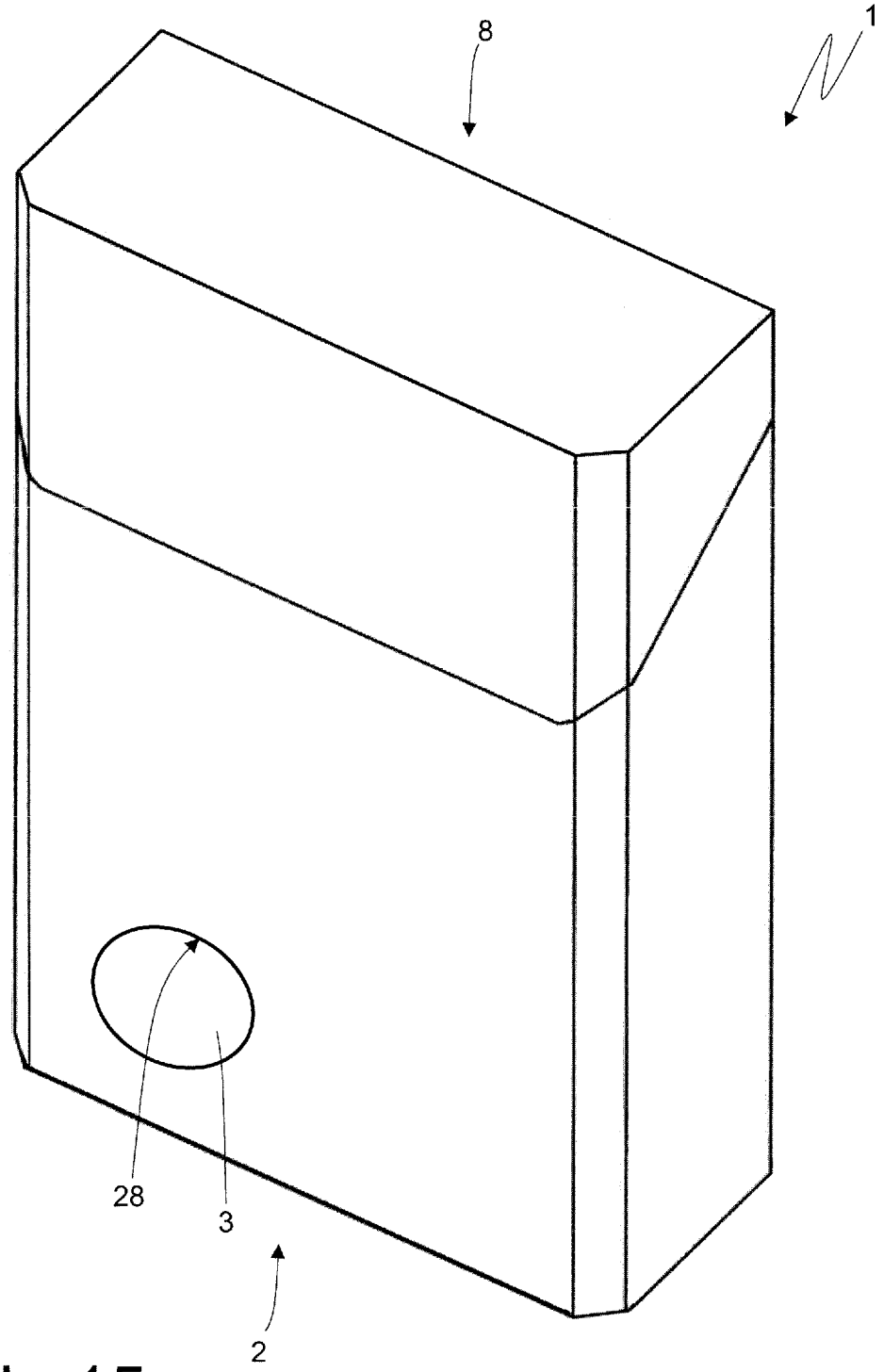
FIG. 15 is a front perspective view of an alternative embodiment of the packet of cigarettes of FIG. 1 in a closed configuration.
Figure 18:
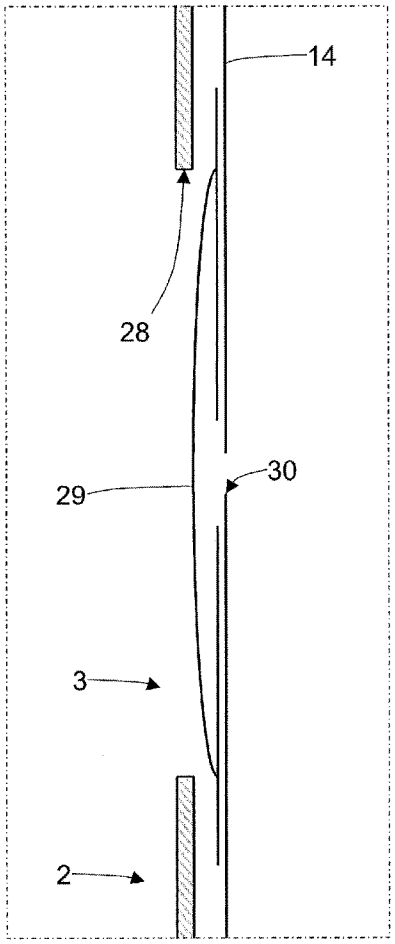
FIGS. 17, 18 and 19 are schematic and longitudinal section views of respective alternatives of the detail of FIG. 16.
Figure 17:
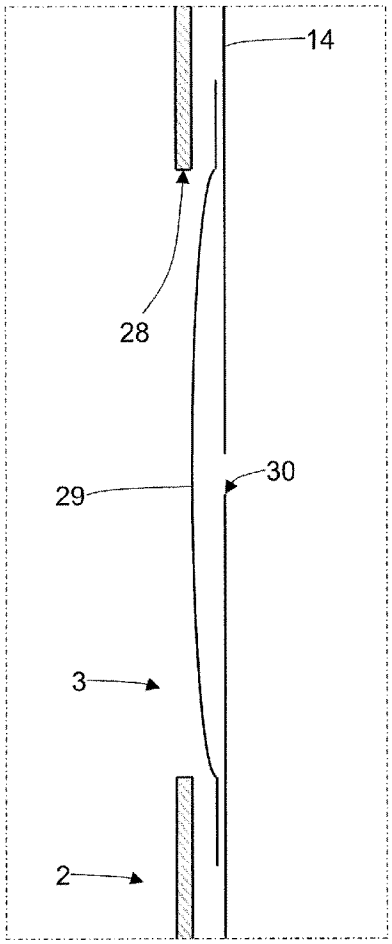
Figure 16:
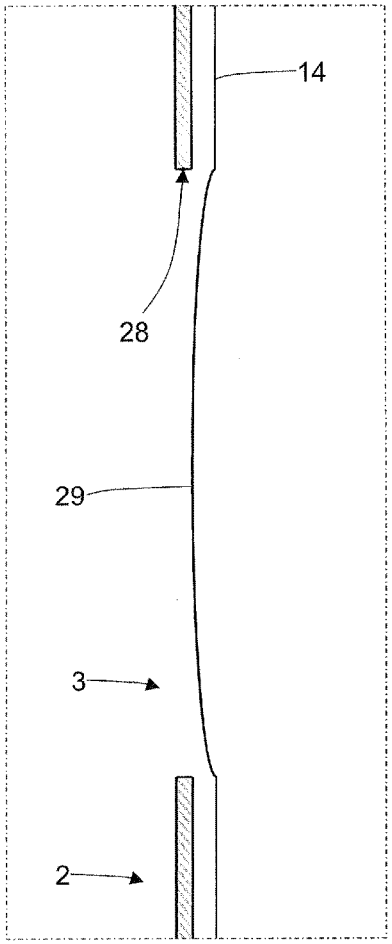
FIG. 16 is a schematic and longitudinal section view of a detail of the packet of cigarettes of FIG. 15.

As previously mentioned, when the sealed wrap 3 has an inner pressure different from the atmospheric pressure (i.e. environmental pressure), the sealed wrap 3 itself undergoes a deformation by effect of the differential between its inner pressure and the atmospheric pressure; said deformation of the sealed wrap 3 due to the pressure differential is completely invisible to the user when the lid 8 is closed (i.e. before opening the packet 1 of cigarettes). As illustrated in FIG. 15, to make the deformation of the sealed wrap 3 visible from the outside also when the lid 8 is closed (i.e. before opening the packet 1 of cigarettes), it is possible to form a through hole 28 on the outer container 2 (or possibly on lid 8) displaying a portion of the underlying sealed wrap 3.

According to a possible embodiment, when the sealed wrap 3 is depressurized (i.e. when the sealed wrap 3 has an inner pressure lower than atmospheric pressure), the portion of the reinforcement element 10 arranged at the through hole 28 may be embossed so as to have a pattern (alphabet letter, symbol, logo . . . ) in relief that is emphasized (i.e. is clearly visible from the outside of the sealed wrap 3) thanks to the fact that the sealed wrap 3 adheres to the reinforcement element 10 due to the depressurization; highlighting in this way the fact that the sealed wrap 3 is depressurized. Alternatively, when the sealed wrap 3 is depressurized (i.e. when the sealed wrap 3 has an inner pressure lower than atmospheric pressure), the reinforcement element 10 has a further through hole, which has the same shape, size and position of the through hole 28 so as to perfectly overlap the through hole 28; in this way, at the through hole 28, the sealed wrap 3 adheres to the underlying cigarettes of group 4 of cigarettes, highlighting the fact that the sealed wrap 3 is depressurized.

According to a possible embodiment illustrated in FIGS. 16-19, when the sealed wrap 3 is pressurized (i.e. when the sealed wrap 3 has an inner pressure higher than the atmospheric pressure), the sealed wrap 3 has a deformable portion 29 that is arranged at the through hole 28 and is suited to deform (inflate) due to the inner pressure of the sealed wrap 3 so as to project outwards from the remaining part of the sealed wrap 3. According to the embodiment illustrated in FIG. 16, the deformable portion 29 consists of a part of the sheet 14 of wrapping material that is locally weakened; for example, the sheet 14 of wrapping material is locally weakened by means of an inelastic deformation induced by a mechanical strut before the sheet 14 of wrapping material is folded around the group 4 of cigarettes. According to the embodiments illustrated in FIGS. 17, 18 and 19, the deformable portion 29 is initially separate and independent of the sheet 14 of wrapping material and is applied (glued or heat sealed) to the sheet 14 of wrapping material generally before the sheet 14 of wrapping material is folded around group 4 of cigarettes; at the deformable portion 29 of the sealed wrap 3 (i.e. the sheet 14 of wrapping material forming the sealed wrap 3) has a through hole 30 that connects the deformable portion 29 with the inside of the sealed wrap 3 to allow the deformable portion 29 to deform as a function of the pressure inside the sealed wrap 3 (i.e. allows the deformable portion 29 to share the same inner pressure of the sealed wrap 3).

Figure 19:
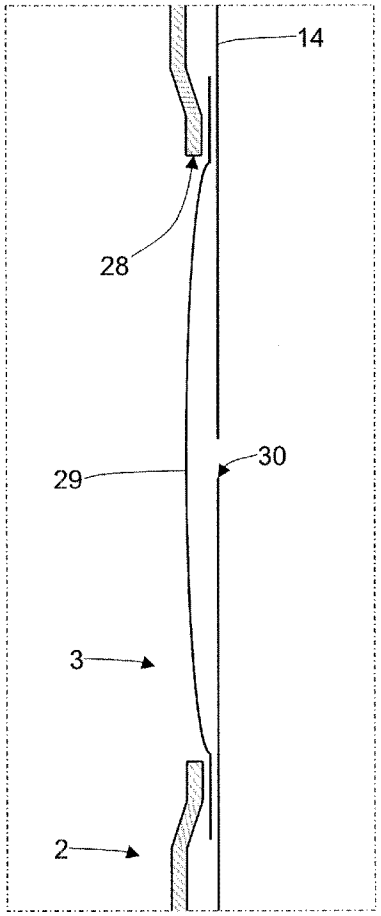

According to the embodiment illustrated in FIG. 19, around the through hole 28 the outer container 2 has a deformation (made for example by means of embossing) which curves inwards (i.e. towards the sealed wrap 3) the outer container 2; in other words, around the through hole 28 the outer container 2 has an inward recess (i.e. towards the sealed wrap 3). Said recess of the outer container 2 around the through hole 28 allows to put greater emphasis on the deformable portion 29 of the sealed wrap 3.

According to a possible embodiment, the outer part and/or the inner part of the deformable portion 29 may incorporate a diffraction grating that modifies the look perceived on the outside (for example the color) as a function of its geometric conformation (or as a function of its shape); in this way when the inner pressure of the sealed wrap 3 is higher than the atmospheric pressure, the deformable portion 29 is "inflated", and therefore appears on the outside having a certain aspect (for example a green colouring to indicate the integrity of the sealed wrap 3), while when the inner pressure of the sealed wrap 3 is lower than the atmospheric pressure the deformable portion 29 is "deflated" and therefore appears on the outside having a different aspect (for example a red colouring to indicate that the sealed wrap 3 has been open and therefore pressurization has been lost).

In the non-limiting embodiment illustrated in the accompanying figures and described above, the pack of the present invention contains a group 4 of cigarettes; however, the pack of the present invention may contain any other type of tobacco articles such as cigars, electrical or electronic cigarettes (i.e. cigarettes that generate an aerosol without combustion), cartridges and refills for electronic cigarettes, new-generation cigarettes.

The sealed wrap 3 described above has various advantages.

First, the sealed wrap 3 allows to preserve more effectively the organoleptic characteristics of the tobacco articles contained within thanks to the fact that the inner pressure of the sealed wrap 3 is different from the atmospheric pressure (i.e. the environmental pressure). In fact, when the inner pressure of the sealed wrap 3 is different from the atmospheric pressure the tobacco articles contained in the sealed wrap 3 are kept in a low oxygen content environment (because part of the oxygen was extracted during the depressurization or because part of the oxygen has been replaced by an inert gas during pressurization).

In addition, by mechanically binding certain parts of the sealed wrap 3 (obviously externally to the pull-out opening 5) to the reinforcement element 10 it is possible to substantially limit the deformations of the sealed wrap 3 by effect of the pressure differential with respect to the external environment. It is important to note that the mechanical binding between the parts of the sealed wrap 3 and the reinforcement element 10 is particularly effective in limiting the deformations of the sealed wrap 3, as said binding can be established and consolidated during the formation of the sealed wrap 3, i.e. before imparting a pressure differential with respect to the external environment to the sealed wrap 3 and therefore before the deformations are formed. In other words, the mechanical binding between the parts of the sealed wrap 3 and the reinforcement element 10 allows to prevent in advance, rather than resolving afterwards any excessive deformations of the sealed wrap 3 due to the effect of the pressure differential with respect to the external environment.

Finally, the sealed wrap 3 described above is also simple and inexpensive to produce, since it is relatively easy to depressurize/pressurize the sealed wraps also in an existing packing machine.

The invention claimed is:

1. Pack (1) comprising:

a group (4) of tobacco articles;

a sealed wrap (3), which has an inner pressure that is different from the atmospheric pressure, encloses the group (4) of tobacco articles, has a pull-out opening (5) for the tobacco articles and consists of a heat-sealable sheet (14) of wrapping material, which is folded around the group (4) of tobacco articles and is stabilized by means of heat-sealing; and a rigid reinforcement element (10), which is arranged on the inside of the sealed wrap (3) in contact with the group (4) of tobacco articles and embraces the group (4) of said tobacco articles;

the pack (1) is characterized in that at least a portion of the sealed wrap (3) is mechanically coupled, by means of glueing or heat-sealing, to a corresponding portion of the reinforcement element (10).

2. A pack according to claim 1, wherein:

the inner wrap (3) comprises an "open & close" sealing panel (6), which is glued to the sheet (14) of wrapping material by interposing a pressure-sensitive repositionable adhesive (16), normally adheres to the part of the sealed wrap (3) that is arranged around the pull-out opening (5) so as to close the extraction opening (5), and can be temporarily raised to free the pull-out opening (5); and the presence of the pressure-sensitive repositionable adhesive (16) between the sealing panel (6) and the sheet (14) of wrapping material causes the permanent glueing of the portion of the sheet (14) of wrapping material enclosed by the incision (15) to the sealing panel (6), and causes a temporary glueing between the portion of the sheet (14) of wrapping material surrounding the incision (15) and the sealing panel (6) so as to normally keep the sealing panel (6) in contact with the sheet of wrapping material (14) to close the pull-out opening (5).

3. A pack according to claim 1 wherein the reinforcement element (10) is "U"-shaped and comprises a front wall (11) and a pair of lateral walls (12).

4. A pack according to claim 1, wherein the reinforcement element (10) has a tubular shape and comprises a front wall (11), a rear wall, and a pair of lateral walls (12).

5. A pack according to claim 1 and comprising a rigid outer container (2) which is cup-shaped and houses the sealed wrap (3); wherein at least a portion of the sealed wrap (3) is mechanically coupled, by means of glueing or heat-sealing, to a corresponding portion of the outer container (2).

* * * * *